United States Patent [19]

Uzaki et al.

[11] Patent Number: 4,781,236

[45] Date of Patent: Nov. 1, 1988

[54] METHOD OF AND DEVICE FOR PRODUCING MOLD CORE

[75] Inventors: Nagato Uzaki, Toyohashi; Isao Atsumi, Toyokawa; Kimikazu Kaneto, Toyohashi; Hisashi Harada, Aichi; Kunihiro Hashimoto, Toyokawa; Osamu Motomatsu, Aichi, all of Japan

[73] Assignee: Sintokogio Ltd., Nagoya, Japan

[21] Appl. No.: 66,362

[22] Filed: Jun. 25, 1987

[30] Foreign Application Priority Data

Oct. 4, 1986 [JP] Japan ..... 61-236828
Oct. 18, 1986 [JP] Japan ..... 61-247968

[51] Int. Cl.[4] ..... B22C 15/28

[52] U.S. Cl. ..... 164/40; 164/37; 164/186; 164/187; 164/195

[58] Field of Search ..... 164/15, 37, 40, 169, 164/186, 187, 207, 210, 212, 228, 195

[56] References Cited

U.S. PATENT DOCUMENTS 4,158,381 6/1979 Michelson ..... 164/228

FOREIGN PATENT DOCUMENTS 414041 7/1974 U.S.S.R. ..... 164/40

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

A method of producing a mold core from green sand, wherein green sand is blown into a mold cavity which is sized to be greater than the size of the mold core to be obtained, so that a preformed mold body is prepared. The preformed mold body is then compacted by a compacting die having a cavity recess which is sized in conformity with the size of the mold core to be obtained, until the preformed mold body size is reduced to the final stage. In consequence, the green sand is compacted to develop uniform distributions of strength and hardness over the entire portion of the mold core as the product.

6 Claims, 1 Drawing Sheet

METHOD OF AND DEVICE FOR PRODUCING MOLD CORE

BACKGROUND OF THE INVENTION

The present invention relates to a method of producing a mold core and a device therefor. More particularly, the invention is concerned with a method of and a device for producing a mold core formed of green sand and having a steep configuration including thin and thick body sections.

Molding methods such as shell mold method, cold box method and $CO_2$ methods are conventionally used in the production of mold cores, mainly for the reasons of strength and dimensional precision of the core to be produced. However, mold cores produced by these known methods are generally expensive and causes a difficulty in the regeneration and reuse of molding sands because the core sand has different characteristics from those of green sand used as the material of the master mold.

Under these circumstances, methods have been developed for producing mold cores from the same green sand as that used in the master mold, and these methods have been successfully used in the production of mold cores having comparatively simple configurations. Such methods are disclosed, for example, in Japanese Patent Laid-Open Nos. 139143/1980 and 195555/1982.

One of such methods employs a longitudinally split type die box which can be split into two parts between which is formed a mold cavity which receives green sand under pressure so as to form a mold core. However, if a mold core having a steep configuration is to be formed by such a known method, difficulties are experienced since it is troublesome to compact or dense the molding sand uniformly over the entire surface of the mold core. In order to avoid producing any non-uniformly compacted mold core, it has been proposed to charge an excess amount of molding sand into a core box. However, such a proposal is still unsuccessful in that it cannot ensure the required uniformity of the sand in the mold core and required high degree of dimensional accuracy particularly when the mold core has a steep configuration.

SUMMARY OF THE INVENTION

The present invention has been accomplished in view of the above-mentioned problems encountered by the conventional methods and devices for producing mold cores.

Therefore, one object of the present invention is to provide a method of and a device for producing a mold core from green sand having a steep configuration including, for example, thick and thin body sections, with high degrees of dimensional accuracy and uniformity of the strength.

According to the present invention, there is provided a method of producing a mold core from green sand composed of first and second core halves which are defined when the mold core is cut along a plane, the first core half having a first outer peripheral surface section and the second core half having a second outer peripheral surface section contiguous to the first peripheral surface section, the first and second outer peripheral surface sections defining thick and thin body sections, including the steps of preparing a first die forming therein a first cavity recess having an inner wall surface by which the first outer peripheral surface of the first core half is formed, preparing a second die forming therein a second cavity recess having depths which are obtained by increasing heights of the second outer peripheral surface measured from the plane such that the amount in which the size of the cavity recess exceeds the size of the thick portion of the final product is greater than the amount in which the size of the cavity recess exceeds the size of the thin portion of the final product, preparing a third die forming therein a third cavity recess having an inner surface by which the second outer peripheral surface section of the second core half is formed, mating the first and second dies with each other so that the first and second cavity recess defining a mold sand receiving cavity having a volume greater than the bulk of the mold core, charging mold sand into the mold sand receiving cavity under pressure effected by compressed air so that a preformed mold body having a bulk greater than that of the mold core is formed, separating the second die from the first die while the preformed mold body is left being held by the first die, and mating the third die with the first die so that the preformed mold body is reduced in size to form the final mold core.

Further, the present invention is to provide a device suitably used for the above-mentioned method, comprising, a first die forming therein a first cavity recess having an inner wall surface by which the first outer peripheral surface section of the first core half is formed, a second die forming therein a second cavity recess having depths which are obtained by increasing height of the second outer peripheral surface measured from the above-mentioned plane such that the amount in which the size of the cavity recess exceeds the size of the thick portion of the final product is greater than the amount in which the size of the cavity recess exceeds the size of the thin portion of the final product, the second die being adapted to be mated with the first die so as to define a mold sand receiving cavity therebetween into which mold sand is charged under pressure to form a preformed mold body having a bulk greater than that of the mold core, and a third die forming a third cavity recess having an inner surface by which the second outer peripheral surface section of the second core half is formed, the third die being adapted to be mated with the first die after the second die is separated from the first die so that the preformed mold body is compacted by the third die, thus forming the final mold core.

BRIEF DESCRIPTION OF THE DRAWINGS

Further objects, features and advantages of the present invention will be more apparent in detail when reference is made in the following description in which a preferred embodiment of the present invention is explained with reference to the accompanying drawings in which.

DESCRIPTION OF THE PREFERRED EMBODIMENT

The invention will be fully described hereinunder with reference to the accompanying drawings.

Figure 1:
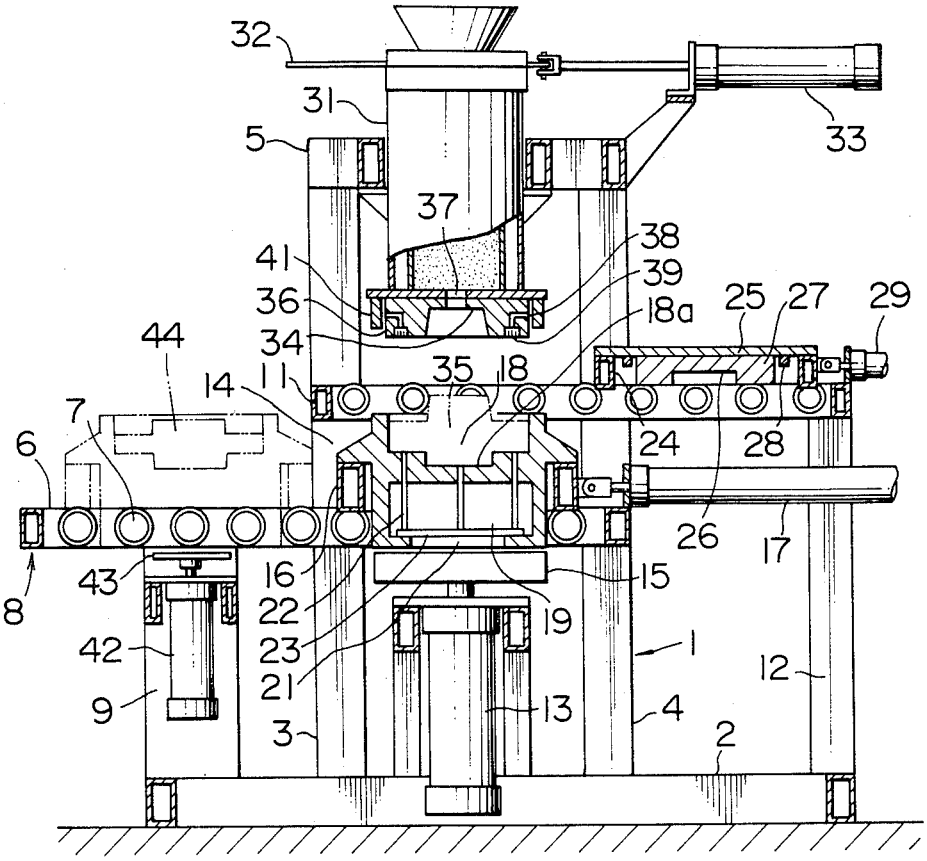
FIG. 1 is a view illustrating a device for producing mold core according to the present invention, in cross-section.

Referring to the drawings, particularly to FIG. 1, a main frame 1 has a gate-like form constituted by a base frame 2 having a rectangular form when viewed in plan, pairs of pillars 3, 4 planted on both longitudinal sides of the base frame 2, and a top frame 5 carried by the upper ends of the pillars 3 and 4. A horizontal roller conveyer 8 is mounted on the main frame 1 closer to the bottom thereof than to the top of the main frame 1. The roller conveyer 8 is composed of a roller frame 6 having a rectangular planar form and a plurality of flanged rollers 7 secured to opposing surfaces of both longitudinal sides of the roller frame 6. More specifically, the horizontal roller conveyer 8 is supported at its one end by the pillars 3, 4, while the other end is supported by a post 9 which stands upright from the left end of the base frame 2 as viewed in FIG. 1. The roller conveyer 8 will be referred to as "lower roller conveyer" hereinunder for the convenience's sake.

Another horizontal roller conveyer 11 having substantially the same shape as the lower roller conveyer 8 is installed on a portion of the main frame 1 closer to the top thereof than to the bottom of the main frame 1. The roller conveyer 11 is supported at its one end by the pillars 3, 4 and at its other end by a post 12 which stands upright from the right end of the base frame 2 as viewed in FIG. 1. The roller conveyer 11 will be referred to as "upper roller conveyer" for the convenience's sake.

An upwardly directed cylinder 13 is mounted on the base frame 2 substantially at the center of the latter and right below the lower roller conveyer 8. The cylinder 13 receives a piston with a piston rod to the free end of which is fixed a table 15 having a shape substantially the same as the form of the bottom of a die 14 which will be mentioned later. The arrangement is such that the table 15 is moved up and down through the space between both longitudinal sides of the roller frame 6 of the lower roller conveyer 8, as the piston rod is extended and retracted by the operation of the cylinder 13.

The lower roller conveyer 8 carries a truck frame 16 which is opened both at the upper and the lower sides thereof. A die 14 is provided with a peripheral flange at a portion near the upper end thereof. The die 14 is carried by the truck frame 16 such that the flange rests on the truck frame 16. The die 14 is located with respect to the truck frame 16 by means of a locating pin which is not shown.

A cylinder 17 is disposed on the right end portion of the lower roller conveyer 8 and is directed leftward. The cylinder 17 receives a piston with a piston rod pinned to the right end wall of the truck frame 16. The arrangement is such that the truck frame 16 and, hence, the die 14 carried by the truck frame 16 are reciprocatable transverse along the lower roller conveyer 8 as the piston rod of the cylinder 17 is extended and retracted.

The die 14 has a cavity recess 18 having a configuration substantially the same as the outer peripheral configuration of the core to be formed. At the same time, a die recess 18*a* having a configuration substantially the same as the bottom configuration of the core to be obtained is formed in the center of the bottom of the above-mentioned cavity recess 18.

A hollow 19 is formed in the lower half part of the die 14. The hollow 19 is communicated with the atmosphere through an opening 21 formed in the bottom of the die 14.

The design is such that a small clearance is formed between the lower end surface of the die 14 and the upper surface of the table 15 when the piston rod of the cylinder 13 is fully retracted. A plurality of ejector pins 22 are provided on the top surface of an ejector plate 23 which is received in the hollow 19. The ejector pins 22 extend upward through the bottom of the upper half part of the die 14 so as to be able to project into the cavity recess 18 and the die recess 18*a*.

Another truck frame 24 which is opened both at the upper and lower sides thereof and, hence, having a construction similar to the truck frame 16 is movably carried by the upper roller conveyor 11. A mounting member 25 is separably carried by the truck frame 24. The mounting member 25 is separably located with respect to the truck frame 24 by means of a locating pin which is not shown. A compacting die 27 is fixed to the underside of the mounting member 25. The compacting die 27 is provided in the center of the underside thereof with a die cavity 26 having a configuration which is substantially the same as the configuration of the upper part of the core to be obtained. The compacting die 27 is adapted to be slided into the cavity recess 18 in the die 14 to a predetermined depth so as to define a cavity having a configuration which is substantially the same as the core to be formed. A stopper 28 is secured to the underside of the mounting member 25 so as to surround the compacting die 27. The arrangement is such that the lower end of the stopper 28 contacts the peripheral portion of the upper surface of the die 14 when the compacting die 27 is moved into the cavity recess 18 of the die 14.

Still another cylinder 29 directed leftward is provided on the right end portion of the upper roller conveyor 11. The cylinder 29 receives a piston with a piston rod the end of which is pinned to the right end wall of the truck frame 24. Thus, the compacting die 27 carried by the truck frame 24 through the mounting member 25 is reciprocatable transverse to the left and right along the upper roller conveyor 11 as the piston rod of the cylinder 29 is extended and retracted.

When the die 14 is positioned just above the table 15, the die 14 is allowed to move up and down through the space formed between both longitudinal sides of the roller frame of the upper roller conveyor 11 in association with the movement of the table 15 by the cylinder 13.

The arrangement is such that a small clearance is formed between the under surface of the compacting die 27 and the upper surface of the die 14 in the normal state, as shown FIG. 1.

A blow tank 31 is disposed above the table 15 and supported by the top frame 5. The blow tank 31 has been charged with a predetermined amount of molding green sand and is adapted to be supplied with compressed air from a compressed air source which is not shown.

The blow tank 31 has a top opening adapted to be opened and closed by a slide gate 32 which in turn is adapted to be reciprocated by a cylinder 33. A blowing die 36 is secured to the underside of the blow tank 31. The blowing die 36 is provided in the center of the underside thereof with a cavity recess 34 of a depth greater than the height of the upper portion of the core to be formed. The blowing die 36 is adapted to be slidingly moved into the cavity recess 18 in the die 14 so as to define, in cooperation with the die 14, a cavity 35 of a size greater than the size of the core to be formed. A sand blowing hole or passage 37 is formed piercing through the center of the bottom wall of the blow tank 31 and the center of the blowing die 36. The blowing die 36 has a plurality of vent passages 38 each of which has one end opening formed in a peripheral portion of the underside of the blowing die 36 and the other end opening formed in the side wall of the blowing die 36. A vent plug 39 is installed in the opening of each vent passage 38 in the underside of the blowing die 36. A stopper 41 is secured to the peripheral portion of the underside of the blow tank 31 so as to surround the blowing die 36. The lower end surface of the stopper 41 is adapted to make into contact with a peripheral portion of the upper surface of the die 14 when the blowing die 36 is slidingly moved into the cavity recess 18 in the die 14. The arrangement also is such that, when the mounting member 25 is in the normal state as shown in FIG. 1, a slight difference in level is formed between the upper surface of the mounting member 25 and the underside of the blowing die 36.

An upwardly directed cylinder 42 is supported on the aforementioned post 9 which is provided on the left end portion of the base frame 2 as viewed in FIG. 1, just under the lower roller conveyor 8. A pusher plate 43, which is shaped and sized to be received in the bottom opening 21 in the die 14, is fixed to the end of the piston rod of the cylinder 42. A slight difference in level is formed between the underside of the die 14 and the upper surface of the pusher plate 43 when the piston rod of the cylinder 42 has been fully retracted.

A description will be made hereinunder as to the process for forming a mold core from green sand.

In a first step of operation, with the table 15, pusher plate 43 and the compacting die 27 being retracted, the cylinder 17 is retracted so as to position the die 14 right above the table 15. In a second step of the process, the piston rod of the cylinder 13 is extended so as to raise the table 15 so that the upper surface of the table 15 is brought into contact with the underside of the die 14 thereby to lift the die 14. In consequence, the die 14 is separated from the truck frame 16 and is lifted through the space between both longitudinal sides of the roller frame of the upper roller conveyor 11. The upward movement of the die 14 causes the cavity recess 18 in the die 14 to receive the blowing die 36. When the blowing die 36 has been inserted into the cavity recess 18 to a predetermined depth, the peripheral portion of the upper surface of the die 14 is stopped by the stopper 41 so that any further extension of the piston rod of the cylinder 13 and, hence, further rise of the die 14 is prevented. In consequence, the die cavity 35 of a size greater than the size of the mold core to be obtained is defined by the cavity recess 18 and the die recess 18*a* in the die 14 and the cavity recess 34 in the blowing die 36.

Figure 2:
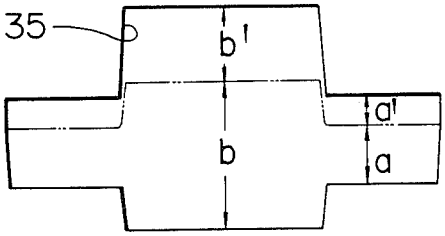
FIG. 2 is a front elevational view illustrating a preformed mold body and a mold cavity therefor in a dimensional relationship therebetween.

The shape and size of the die cavity 35 will be explained in more detail. As will be seen from FIG. 2, the die cavity 35 is defined by the cavity recesses 18, the die recesses 18*a* and 34 in both dies 14 and 36. The die recess 18*a* for forming the lower half part of the mold core is exactly shaped and sized in confirmity with the lower half part of the final product, i.e., the mold core to be formed. However, the cavity recess 34 for forming the upper half part of the final product is sized to exceed the size of the upper half part of the final product to be obtained. The amount of excession in size is not uniform. Namely, referring to FIG. 2, the amount (b′) in which the height (b+b′) of the cavity recess 34 exceeds the height (b) of the thick portion of the final product is greater than the amount (a′) in which the height (a+a′) of the cavity recess 34 exceeds the height (a) of the thin portion of the final product. In addition, the ratio between the volume of the final product and the amount of excession in the volume is substantially the same both at the thick and thin portions of the final product: that is, the condition of a:a′=b:b′ is met. In other words, the ratio between the amounts (b′) and (a′) of excession is substantially equal to the ratio between the size (b) and (a) of the thick and thin portions of the final product.

Then, in a third step, compressed air is forcibly supplied into the blow tank 31 the top opening of which has been closed by the slide gate 32, so that the green sand in the blow tank 31 is forced into the die cavity 35 through the sand blowing passage 37 so as to charge the die cavity 35. At the same time, the compressed air blown into the die cavity 35 together with the green sand is discharged to the atmosphere through the vent passages 38.

After the blowing of the green sand into the die cavity 35, any residual pressure in the blow tank 31 is relieved and a fourth step is executed in which the piston rod of the cylinder 13 is retracted to lower the table 15 and, hence, the die 14. As a result, the die 14 is separated from the blowing die 36 and a preformed mold body is left being held by the cavity recess 18 and the die recess 18*a* within the die 14. As the piston rod of the cylinder 13 is further retracted, the die 14 comes to rest on the truck frame 16 and, thereafter, the table 15 continues to move downward alone to its lower stroke end.

In a fifth step, the cylinder 29 operates to extend its piston rod thereby placing the compacting die 27 in the space between the blowing die 36 and the die 14 at a position right above the die 14. Then, in a sixth step, the cylinder 13 is operated again to extend its piston rod so that the table 15 and, therefore, the die 14 are raised together with the preformed mold body held in the latter so that the preformed mold body is brought into contact at its upper surface with the die cavity 26 in the compacting die 27. This in turn causes the mounting member 25 to be separated from the truck frame 24 so as to make the rear side of the mounting member 25 into contact with the underside of the blowing die 36. The cylinder 13 further continues to extend so that the cavity recess 18 of the die 14 comes to slidingly receive the compacting die 27, thereby compacting the preformed mold body held on the die 14. When the compacting die 27 has been moved into the cavity recess 18 in the die 14 to a predetermined depth, the peripheral portion of the upper end surface of the die 14 is made into contact with and stopped by the stopper 28, thereby any further extension of the piston rod of the cylinder 13 and, therefore, further rise of the table 15 and the die 14 are prevented. As a result, the preformed mold body is compacted into the shape and size of the mold core 44 as the final product.

Then, in a seventh step, the cylinder 13 operates to retract its piston rod so as to lower the compacting die 27 and the die 14 together with the table 15. As a result, the compacting die 27 comes to rest on the truck frame 24 through the intermediary of the mounting member 25 so as to stop its downward movement. As a consequence, the compacting die 27 is separated from the die 14, while the mold core 44 as the final product is left in the cavity recess 18 of the die 14. As the table 15 is further moved downward, the die 14 comes to rest on the truck frame 16 so that the table 15 alone continues to move downward.

In a subsequent step, i.e., eighth step, the cylinder 17 is operated to extend its piston rod thereby moving the die 14 to a position right above the pusher plate 43. Then, in a ninth step, the cylinder 42 is operated to extend its piston rod so that the pusher plate 43 is raised through the opening 21 in the die 14 thereby urging the ejector plate 23 in the die 14 to be pushed upward. Consequently, the ejector pins 22 on the ejector plate 23 pushes the mold core 44 in the cavity recess 18 of the die 14 thereby ejecting the mold core 44.

Then, the mold core 44 is removed manually or by means of a suitable tool, and the pusher plate 43 is lowered so as to retract the ejector pins 22. Then, in a tenth step, the cylinder 17 operates to retract its piston rod so that the die 14 is moved to the position right above the table 15.

Meanwhile, the blow tank 31 is charged with a new batch of green sand, and the compacting die 27 is moved away from the position intermediate between the blowing die 36 and the die 14 by the retracting operation of the cylinder 29.

The series of operation having the described steps is repeated cyclically so that the mold cores of the same shape and size are consecutively produced from the green sand.

In the described embodiment, the ratio in the amount of increase in the size of the cavity formed between the die 14 and the blowing die 36 is selected to meet the condition of $a:a'=b:b'$. This, however, is not essential and the present invention produces an appreciable effect when the size of the die cavity at the thick and thin areas is selected to merely satisfy the condition of $a'<b'$.

It is to be understood also that the provision of the die recess 18*a* in the bottom of the cavity recess 18 is not essential. Namely, in some cases, the die recess 18*a* is omitted or a protrusion is formed instead of the die recess 18*a*.

It will also be obvious to those skilled in the art that the blowing die 36 and the compacting die 27 can have protrusions in their cavities in conformity with variation in the thickness of the product, although in the described embodiment the cavity recesses have a simple concaved forms.

As will be fully understood from the foregoing description, according to the present invention, a green sand mold core having portions of different thicknesses is produced by forming a mold cavity the size of which is increased in the vertical direction over the size of the final product, i.e., the mold core, blowing green sand into the cavity so as to form a preformed mold body, and compacting the preformed mold body into the final shape and size. The critical feature of the present invention resides in that the amount of increase in the size of the cavity over the size of the mold core as the final product is greater at the portion of the die cavity corresponding to the thick portion of the mold core than at the portion of the die cavity corresponding to the thin portion of the mold core. According to the invention, therefore, the mold core as the final product, produced by compacting the preformed mold body, exhibits a substantially uniform distribution of strength despite any variation in the thickness.

It is also to be noted that the green sand constituting the thick portion of the preformed body is well compacted so that the transferability is improved particularly in this portion, thus ensuring a high dimensional accuracy of the mold core as the final product.

What is claimed is:

1. A method for molding a mold core having an outer peripheral surface, end surfaces, and thick and thin sections from green sand in a mold composed of core sections defined by dividing said core along a plane, said core sections having inner peripheral surfaces which are contiguous, when said mold sections are positioned end to end, providing therein space for producing a mold core, said method including the steps of:

preparing a first die by closing the end of one of said core sections when said sections are positioned end to end and forming in said end of said one of said core sections an end wall surface by which the outer peripheral surface and an end surface of said mold core is to be formed;

preparing a second die by forming therein shallow and deep recesses which correspond to said thick and thin core sections to be formed, said shallow and deep recesses forming a mold sand receiving cavity, when said second die is mated with said first die and molding sand is charged into said cavity, such that said shallow and deep recesses in said cavity have depths which are greater than the thicknesses of said corresponding thick and thin core sections to be molded, with the ratios between said greater depths of said shallow and deep recesses and the thickness of the corresponding thick and thin core sections being constant;

preparing a third die by forming therein shallow and deep recesses which correspond to said thick and thin core sections to be formed and to said shallow and deep recesses in said second die, said shallow and deep recesses formed in said cavity between said third die and said first die having depths substantially equal to the thicknesses of said corresponding thick and thin core sections when said third die compresses the mold said therein;

mating said first and second dies with each other to form therebetween said mold sand receiving cavity;

charging mold sand into said mold sand receiving cavity under pressure effected by compressed air so that a preformed mold body having a bulk greater than that of the mold core to be produced is formed;

separating said second die from said first die and said preformed mold body leaving said preformed mold body on said first die;

mating said third die with said first die and said preformed mold body; and compressing said preformed mold body between said first die and said third die to reduce the thickness of said preformed mold body and to form said mold core with said thick and thin section.

2. A molding device for molding a green sand mold core having an outer peripheral surface, end surfaces and thick and thin sections, said device having core sections defined by dividing said mold core along a plane, said core sections having inner peripheral surfaces which are contiguous when said sections are positioned end to end, providing therein space for producing a mold core comprising:

a first die forming a closure for the end of one of said core sections and an end wall of said one of said core sections for forming an end surface of said mold core;

a second die for insertion into said one of said core sections and having a surface facing said first die with shallow and deep recesses which correspond to said thick and thin core sections to be formed, said shallow and deep recesses forming a mold sand receiving cavity, when said second die is mated with said first die and molding sand is charged into said cavity, such that said shallow and deep recesses in said cavity have depths which are greater than the thicknesses of said corresponding thick and thin core sections to be molded, with the ratios between said greater depths of said shallow and deep recesses and the thicknesses of the corresponding thick and thin core sections being constant;

a third die for insertion into said one of said core sections and having a surface facing said first die with the shallow and deep recesses which correspond to said thick and thin core sections to be formed, said shallow and deep recesses formed in said cavity between said third die and said first die having depths substantially equal to the thicknesses of said corresponding thick and thin core sections when said third die compresses the mold sand therein;

means for charging mold sand under compressed air pressure into said mold sand receiving cavity between said first and second dies, when said cavity is formed, for forming a preformed mold body having a bulk greater than that of the mold core to be molded; and means for removing said second die from said one of said core sections and for inserting said third die into said one of said core sections for compressing said preformed mold body between said first die and said third die to reduce the thickness of said preformed mold body to form said mold core with said thick and thin sections.

3. A device as set forth in claim 2, wherein said third die includes stop means for limiting the depth of said inserting of said third die into said one of said core sections for such compressing of said preformed mold body.

4. A device as set forth in claim 3, wherein said first die includes means for elevating said first die for forming said closure for said end of said one of said core sections and elevating said one of said core sections with said first die closure thereon for said insertion of said second die into said one of said core sections, said second die being stationary above said first die, and means for moving said third die horizontally between said first and second dies when said first die is lowered.

5. A device as set forth in claim 4, wherein said first die further includes means for horizontally reciprocating said first die between a first position directly below said second die and a second position horizontally outward from said second die.

6. A device as set forth in claim 5, further comprising an ejector mechanism disposed in said first die and a push-up mechanism at said second position for actuating said ejector mechanism when said first die is moved to said second position.

* * * * *